US008911043B2

(12) United States Patent
Gengrinovich et al.

(10) Patent No.: US 8,911,043 B2
(45) Date of Patent: Dec. 16, 2014

(54) INK DELIVERY SYSTEM

(71) Applicant: Hewlett-Packard Industrial Printing Ltd, Netanya (IL)

(72) Inventors: Semion Gengrinovich, Ramat Gan (IL); Ran Vilk, Qiryat Ono (IL); Eldad Manheim, Arsuf (IL)

(73) Assignee: Hewlett-Packard Industrial Printing Ltd., Netanya (IL)

( * ) Notice: Subject to any disclaimer, the term of this patent is extended or adjusted under 35 U.S.C. 154(b) by 134 days.

(21) Appl. No.: 13/660,153

(22) Filed: Oct. 25, 2012

(65) Prior Publication Data

US 2014/0118429 A1 May 1, 2014

(51) Int. Cl.
*B41J 29/38* (2006.01)
*B41J 2/175* (2006.01)

(52) U.S. Cl.
USPC ..... 347/6; 347/85

(58) Field of Classification Search
CPC ..... B41J 2/125; B41J 2/1404; B41J 2/14427; B41J 2/1603; B41J 2/1623; B41J 2/1628; B41J 2/1631; B41J 2/1639; B41J 2/1642; B41J 2/175; B41J 2/17509; B41J 2/17513; B41J 2/1752; B41J 2/17523; B41J 2/17553; B41J 2/17556; B41J 2/17596; B41J 2/18; B41J 2002/14387; B41J 2202/20
USPC ..... 347/6, 44, 54, 65, 84–87, 89
See application file for complete search history.

(56) References Cited

U.S. PATENT DOCUMENTS

| | | | | |
|---|---|---|---|---|
| 2002/0080215 | A1* | 6/2002 | Sakaida et al. | 347/71 |
| 2007/0291086 | A1* | 12/2007 | Murakami et al. | 347/85 |
| 2010/0039486 | A1* | 2/2010 | Wouters et al. | 347/92 |
| 2011/0115844 | A1* | 5/2011 | Ozawa | 347/28 |

* cited by examiner

*Primary Examiner* — Manish S Shah
*Assistant Examiner* — Roger W Pisha, II

(57) ABSTRACT

An ink delivery device, method and non-transitory computer readable medium, the device may include a first closed pathway for a first ink flow through a multi-nozzle printhead in a first direction, and a second closed pathway for a second ink flow through the multi-nozzle printhead, the second pathway configured to move the second ink flow in a second direction. The device may further include a first shunt between the first closed pathway and the second closed pathway at a first end of the multi-nozzle printhead, the first shunt allowing some of the first ink flow to merge with the second ink flow, and a second shunt between the first closed pathway and the second closed pathway at a second end of the multi-nozzle printhead, the second shunt allowing some of the second ink flow to merge with the first ink flow.

20 Claims, 4 Drawing Sheets

INK DELIVERY SYSTEM

BACKGROUND

Inkjet printing technology creates images by ejecting small ink droplets onto a substrate from multiple nozzles of a printhead assembly. Inkjet printing is very versatile and can be used for a wide variety of printing applications. For example, inkjet printing devices are widely used to produce standard consumer documents, for example photographic prints or reports on standard Letter, Legal or A4 size paper. However, inkjet printing devices are also often used to print images onto large signage items such as billboards and banners.

In printing items other than standard sized documents, such as signage, the substrate that receives the printing is often not of a white color. Nevertheless, the color accuracy of the printed image may be generally dependent on the whiteness of the surface on which it is printed. Consequently, a white layer may be applied to a substrate before an image is printed using an inkjet system.

BRIEF DESCRIPTION OF THE DRAWINGS

In order to better understand the present examples, and appreciate its practical applications, the following Figures are provided and referenced hereafter. It should be noted that the Figures are given as examples only and in no way limit the scope of the examples. Like components are denoted by like reference numerals.

Figure 1A:
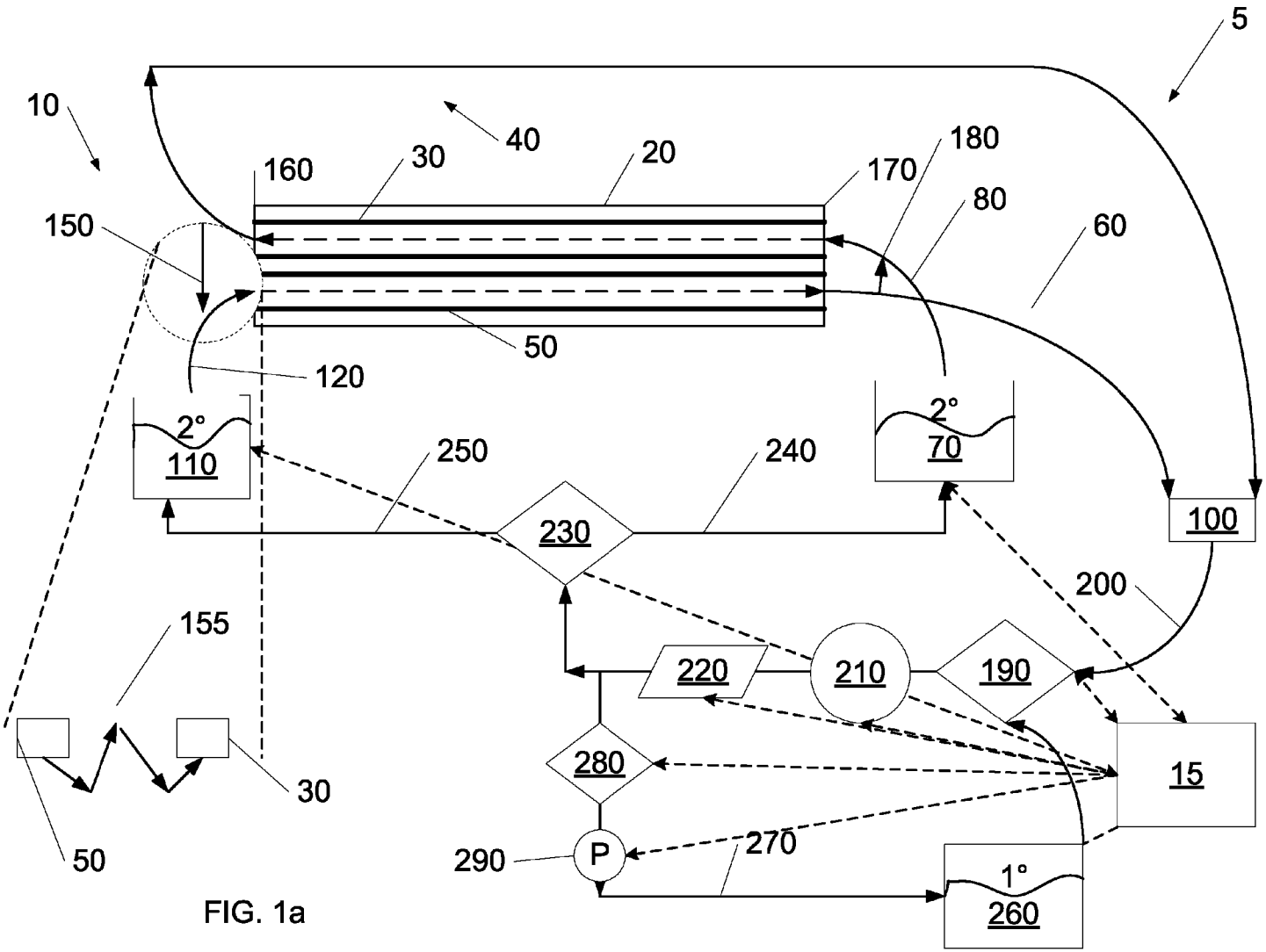
FIG. 1*a* is a schematic illustration of a device in an ink delivery system, according to an example.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following detailed description, numerous specific details are set forth in order to provide a thorough understanding of the methods and apparatus. However, it will be understood by those skilled in the art that the present methods and apparatus may be practiced without these specific details. In other instances, well-known methods, procedures, and components have not been described in detail so as not to obscure the present methods and apparatus.

Although the examples disclosed and discussed herein are not limited in this regard, the terms "plurality" and "a plurality" as used herein may include, for example, "multiple" or "two or more". The terms "plurality" or "a plurality" may be used throughout the specification to describe two or more components, devices, elements, units, parameters, or the like. Unless explicitly stated, the method examples described herein are not constrained to a particular order or sequence.

Additionally, some of the described method examples or elements thereof can occur or be performed at the same point in time.

Unless specifically stated otherwise, as apparent from the following discussions, it is appreciated that throughout the specification, discussions utilizing terms such as "adding", "associating" "selecting," "evaluating," "processing," "computing," "calculating," "determining," "designating," "allocating" or the like, refer to the actions and/or processes of a computer, computer processor or computing system, or similar electronic computing device, that manipulate, execute and/or transform data represented as physical, such as electronic, quantities within the computing system's registers and/or memories into other data similarly represented as physical quantities within the computing system's memories, registers or other such information storage, transmission or display devices.

FIG. 1*a* is a schematic illustration of an ink delivery system, according to an example.

An ink delivery system 10 includes a processing unit 15 for controlling one or a plurality of ink flows related to a printing system, including, in some examples, a multi-nozzle printhead 20. Processing unit 15 may include one or a plurality of components related to processing including memory, see, for example, FIG. 1*b* and the corresponding description below.

Multi-nozzle printhead 20 may be configured to span a print-zone, the print-zone may include a table or a surface (hereinafter "table"). A substrate may be placed, manually, automatically, or semi-automatically on top of the table. The substrate may be placed on the table for printing, or to be prepared for printing by a printer.

Multi-nozzle printhead 20 may contain a number of nozzles, the nozzles configured to deposit ink on a substrate. In some examples, the multi-nozzle printhead may contain from 2 to 100 nozzles. Some printheads may contain substantially more nozzles.

Ink delivery system 10 may include, in some examples, an ink circulation system 5 for circulating ink (e.g., white ink) between, or in some examples, during, successive print jobs. In some examples, ink circulation system 5 may circulate ink through ink delivery system 10, and/or multi-nozzle printhead 20 at a velocity of between 450 cubic centimeters per minute (cc/min) and 350 cc/min, e.g., at 400 cc/min. In some examples, the velocity and/or flow of ink through ink circulation system 5 may be configured to limit back pressure on nozzles within multi-nozzle printhead 20.

Ink circulation system 5 may be attached to an application system for applying ink, e.g., white ink, during the print job, for example, a printing application, as described below. The application system may include printer nozzles; the printer nozzles may be included within multi-nozzle printhead 20. Ink delivery system 10 may also be configured to drain the ink, in some examples, white ink, in response to a time interval between two successive print jobs being greater than a threshold length. For example, the threshold length for draining or circulating the ink in the system may be set to a predefined time period, e.g. 45 minutes. If 45 minutes pass without a print job using white ink being performed, then the system may be drained of any ink, e.g., white ink, and flushed with a flushing solution. In some examples, after a shorter period of time has passed, ink circulation system 5 may also circulate the ink through ink delivery system 10.

Multi-nozzle printhead 20 may be configured to sit in a stationary position over the table and/or the substrate and print on the substrate. In some examples, multi-nozzle printhead 20 may be configured to move in a single direction or a plurality of directions relative to the substrate and/or the table.

In some examples, multi-nozzle printhead 20 may be a structure designed to hold several printhead nozzles. Each printhead nozzle may be spatially located so as to cover a specific range over the substrate. As the multi-nozzle printhead 20 moves with respect to the substrate and/or the substrate moves underneath multi-nozzle printhead 20, a control system, e.g., processing unit 15, or other processing units, may send a signal to the appropriate nozzle of multi-nozzle printhead 20 to eject an ink droplet. Ink droplets may be ejected in a specific pattern so as to create a desired image on substrate.

Nozzles may be configured to eject ink onto the substrate through a variety of methods. One method, referred to as thermal inkjet printing, includes the use of a small ink chamber containing a droplet of ink. A heating resistor is used to heat the ink chamber to a specific temperature when an electric current is applied. Due to various physical properties, this heating increases the pressure inside the small ink chamber and propels the droplet out of the nozzle and onto the substrate. The void in the chamber then draws in more ink from a reserve tank. The control system may be used to cause electric current to flow through the appropriate heating resistors at the appropriate times.

Inkjet printers and other printers that may employ multi-nozzle printhead 20 may be used to print images onto a wide variety of substrate materials. Some substrate materials may be of a non-white color or even transparent. A color image printed onto such a substrate may lose color accuracy due, at least in part, to the absence of a white background. Such a loss of color accuracy may cause the image to appear differently than intended. This issue may be resolved by printing a white image onto the non-white substrate before printing the color image. A white layer is often printed onto the non-white substrate before the substrate is provided to the inkjet printer to have the color image printed. In some examples, a white layer may be printed using an alternate printing method such as screen printing. White ink, and in some examples, other ink colors and shades, may generally not be well suited to inkjet technologies.

The ink delivery system, or a portion thereof, may be a component within a system, e.g., a printer. The printer may be configured to print for extended periods. The printer may be configured to print periodically, where under some conditions the printer may be in an off, standby or non-printing mode.

In some examples, ink circulation system 5 within ink delivery system 10 may be in an activated state and circulating ink only when the printer is not printing. In some examples, ink circulation system 5 within ink delivery system 10 may be in an activated state and circulating ink while the printer is printing.

When a printer is in a non-printing or standby mode, ink delivery system 10, or a portion thereof, may be configured to begin a process wherein ink in ink delivery system 10 and/or in the printer may be flowed and/or circulated within an open, closed, or partially closed system. The circulation of the ink may be configured to prevent heavier particles within the ink from settling or falling out of solution and possibly causing a nozzle to clog, or may lead to other problems in ink delivery system 10.

In some examples, the problem of particles settling out of solution may be more pronounced in some ink colors compared to other ink colors. In some examples, white ink may include silica and/or titanium dioxide (titanium (IV) oxide, $TiO_2$ or Titania). $TiO_2$ is the naturally occurring oxide of titanium, and when used within a pigment, it is called titanium white, Pigment White 6, or CI 77891. $TiO_2$ has a high relative brightness compared to other materials as well as a relatively high refractive index.

$TiO_2$ may, when sufficient quantities settle out of solution, prevent a printer from operating properly. The chemical properties of white ink containing $TiO_2$ are such that certain particles, including the white pigment, are suspended in the ink solution. Due to the higher density of white pigments such as $TiO_2$, the particles will begin to precipitate. Upon precipitation, the white pigment particles may become clumped to form a more solid material referred to as the precipitate. The remaining ink solution may be referred to as the supernate. The precipitate material may clog the nozzles of a printhead assembly and create unwanted buildup throughout the ink delivery system 10 and/or other systems. By reducing the rate of precipitation within the white ink solution, the ink delivery system may be protected from such buildup and/or nozzle clogging.

In some examples, multi-nozzle printhead 20 may include one or a plurality of pathways for the movement of ink. In some examples, multi-nozzle printhead 20 may include a pipe 30, tube or similar device for the conveyance of liquid through multi-nozzle printhead 20 within a first closed pathway 40 in a first direction.

Pipe 30 through multi-nozzle printhead 20 may have a diameter of a standard size in an ink delivery or ink circulation system. In some examples, there may be other pipes that are coupled to multi-nozzle printhead 20, including, pipes that are configured to carry water into and out of multi-nozzle printhead 20.

In some examples, multi-nozzle printhead 20 may include a pipe 50, tube or similar device for the conveyance of liquid through multi-nozzle printhead 20 within a second closed pathway 60 in a second direction. In some examples, pipe 30 and pipe 50 may run parallel to each other. In some examples, pipe 30 and pipe 50 may run nearly parallel to each other. In some examples, pipe 30 and pipe 50 may allow ink to travel through each pipe respectively in a direction that is the opposite, or not opposite, to the ink travelling in the other pipe. In some examples, pipe 30 and pipe 50 may not be parallel to each other. In some examples, the flow of ink in pipe 30 and pipe 50 may not be in opposite directions relative to each other.

In some examples, ink flowing through pipe 30 may flow in a first closed pathway 40 (e.g., a circuit). In some examples, first closed pathway 40 may include one or a plurality of ink reservoirs, e.g., a secondary ink reservoir 70. Ink from secondary ink reservoir 70 may flow through a pipe 80, continue flowing through pipe 30 through multi-nozzle printhead 20, and out of multi-nozzle printhead 20 into a pipe 90 in first closed pathway 40, pipe 90 may terminate at a T'-type junction 100.

Secondary ink reservoir 70 and/or a secondary ink reservoir 110 may act as a temporary and/or immediate storage for ink being delivered to multi-nozzle printhead 20.

Whilst the printer is printing a print job, multi-nozzle printhead 20 may be applying ink to the substrate while drawing from secondary ink reservoir 70 and/or secondary ink reservoir 110. Secondary ink reservoir 70 and/or secondary ink reservoir 110 may include floats which indicate their current ink levels to a control system. A control system, e.g., processing unit 15, may respond by configuring an ink pump to pump more ink through a filter and into secondary ink reservoir 70 and/or secondary ink reservoir 110. Conversely, if secondary ink reservoir 70 and/or secondary ink reservoir 110 are becoming too full, a control system may respond by configuring an ink pump to pump less ink into secondary ink reservoir 70 and/or secondary ink reservoir 110.

Multi-nozzle printhead 20 may, in some examples, not use all of the ink supplied through secondary ink reservoir 70 and/or secondary ink reservoir 110. As a result, some of the unused ink may flow back into ink delivery system 10. If the time intervals between successive print jobs are relatively short, the ink may stay in the ink inkjet delivery system. For example, if the time interval between successive print jobs ranges from 5 to 15 minutes, then the ink may be left in ink delivery system 10 and/or ink circulation system 5 and continue to circulate. However, if the time interval between successive print jobs exceeds a predetermined threshold, it may be beneficial to drain the ink from ink delivery system 10 in order to prevent excessive precipitation. Although the circulation may reduce the rate of precipitation, it may not eliminate the precipitation process completely.

A first shunt 150 between first closed pathway 40 and second closed pathway 60 at a first end 160 of multi-nozzle printhead 20, may allow for some ink to exit first closed pathway 40. This exiting of first closed pathway 40 may limit stress on multi-nozzle printhead 20. First shunt 150 may be configured to allow some of the first ink flow in first closed pathway 40 to merge with the second ink flow in second closed pathway 60.

Control and/or direction of an ink flow through first shunt 150 may be managed by processing unit 15. In some examples, ink flow through first shunt 150 may be maintained, increased, decreased, sped up, slowed down or otherwise changed through the use of one or a plurality of components of ink circulation system 5, for example, one or a plurality of pumps and/or valves, the pumps and valves, for example, as described below.

A second shunt 180 between second closed pathway 60 and first closed pathway 40 at a second end 170 of multi-nozzle printhead 20, may allow for some ink to exit second closed pathway 60. This exiting of second closed pathway 60 may limit stress on multi-nozzle printhead 20. Second shunt 180 may be configured to allow some of the second ink flow in second closed pathway 60 to merge with first ink flow in first closed pathway 40.

Direction and/or control of an ink flow through second shunt 180 may be managed by processing unit 15. In some examples, ink flow through second shunt 180 may be maintained, increased, decreased, sped up, slowed down or otherwise changed through the use of one or a plurality of components of ink circulation system 5, for example, one or a plurality of pumps and/or valves, the pumps and valves, for example, as described below.

In some examples, first shunt 150 and/or second shunt 180 may be configured to have a shape 155 wherein the movement of liquid and sediment are controlled, to some degree by the shape of the shunt. In some examples, the shape of first shunt 150 and/or second shunt 180 may include an inverted 'V' and/or a 'W' shape.

In some examples, ink flowing through pipe 50 may flow in second closed pathway 60 (e.g., a circuit). In some examples, second closed pathway 60 may include secondary ink reservoir 110. Ink from secondary ink reservoir 110 may flow through a pipe 120, continue flowing through pipe 50 through multi-nozzle printhead 20, and out of multi-nozzle printhead 20 into pipe 130 in second closed pathway 60, pipe 130 may terminate at 'T'-type junction 100.

In some examples, 'T'-type junction 100 may feed into a combined ink flow pathway 200 from first closed pathway 40 and second closed pathway 60, or a portion thereof, into a valve 190 or similar device, e.g., a three way valve, or similar valve. Combined ink flow pathway 200 may include a pump 210, the pump may be a mechanical, electrical or other type of pump. Combined ink flow pathway 200 may include a filter 220. Filter 220 may be one or a combination of disparate filters. Filter 220 may be used to filter any accumulated and unwanted particles from the ink. Filter types may be specific to the ink type in combined ink flow pathway 200, or may be indifferent to ink type in combined ink flow pathway 200. Pump 210 may be configured to be placed upstream of filter 220. In some examples, pump 210 may be configured to be placed downstream of filter 220. Other components may be included, either upstream, downstream or both upstream and downstream from pump 210.

In some examples, combined ink flow pathway 200 may include a valve 230. Valve 230 may be a three way valve. Valve 230 may be another type of valve. Valve 230 may split the ink flow from combined ink flow pathway 200 into a pathway 240 to secondary ink reservoir 70 and a pathway 250 to secondary ink reservoir 110. Secondary ink reservoir 70 and secondary ink reservoir 110 may be open air reservoirs. In some examples, secondary ink reservoir 70 and/or secondary ink reservoir 110 may be sealed from environmental factors and/or contaminants.

Valve 190 may also accept ink flow from a primary ink reservoir 260 to valve 190 to be transferred eventually to first closed pathway 40 or second closed pathway 60 or another ink flow pathway. Primary ink reservoir 260 may be an open air reservoir. In some examples, primary ink reservoir 260 may be sealed from environmental factors and/or contaminants.

In some examples, a portion of ink flow from combined ink flow 200 may be shunted, in some examples, downstream of filter 220, into a primary ink source pathway 270. Primary ink source pathway 270 may include a valve 280, e.g., a two-way valve, a pump 290 and/or other components. Primary ink source pathway 270 may terminate at primary ink reservoir 260.

Primary ink reservoir 260, and/or in some examples, secondary ink reservoir 70 and/or secondary ink reservoir 110 may be used to store the bulk of the ink present in ink delivery system 10. Primary ink reservoir 260, and in some examples, secondary ink reservoir 70 and/or secondary ink reservoir 110 may have a conical structure for the purpose of funneling ink at the bottom of primary ink reservoir 260, and in some examples, secondary ink reservoir 70 and/or secondary ink reservoir 110 to a load cell. The load cell may include an ink drain and a conduit for providing ink from primary ink reservoir 260, and in some examples, secondary ink reservoir 70 and/or secondary ink reservoir 110 to a valve, e.g. valve 190, valve 280 and/or valve 230. From the valve, the ink can be re-circulated into primary ink reservoir 260, and in some examples, secondary ink reservoir 70 and/or secondary ink reservoir 110, or provided to an application system, e.g., a printing system for output. Primary ink reservoir 260, and in some examples, secondary ink reservoir 70 and/or secondary ink reservoir 110 may also have a cap on top with a hole for receiving an ink return pipe.

The cap may further include a vent for allowing the ink within primary ink reservoir 260, and in some examples, secondary ink reservoir 70 and/or secondary ink reservoir 110 to interact with an ambient atmosphere exterior to primary ink reservoir 260, and in some examples, secondary ink reservoir 70 and/or secondary ink reservoir 110. Primary ink reservoir 260 may be loaded with ink from a reserve location either manually or automatically. Before being loaded into primary ink reservoir 260, the ink may be primed. The ink may be primed by stiffing and other such methods to sufficiently remove precipitate material and ensure a uniform solution of suspended white pigment particles.

In some examples, processing unit 15 may control valve 190, valve 230 and/or valve 280. In some examples, processing unit 15 may control pump 210 and/or pump 290. In some examples, processing unit 15 may control additional valves, pumps and/or other components in ink delivery system 10 and/or ink circulation system 5. In some examples, processing unit may send commands to valve 190, valve 230 valve 280, pump 210 and/or pump 290 via a wired or wireless connection. In some examples, processing unit 15 may be configured to control the amount of flow and/or the direction of the flow in first shunt 150 and/or second shunt 180, for example, as described above.

In some examples, processing unit 15 may implement software; the software may be configured to control the circulation of ink when the printer is not printing. In some examples, the software may be configured to control the circulation of ink while the printer is printing.

In some examples, processing unit 15 may determine if new ink needs to be added to ink delivery system 10 and/or ink circulation system 5, e.g., a scale may be coupled to secondary ink reservoir 70 and/or secondary ink reservoir 110. The scale may be configured to determine, by weight, whether new ink should be added to secondary ink reservoir 70 and/or secondary ink reservoir 110.

Figure 1B:
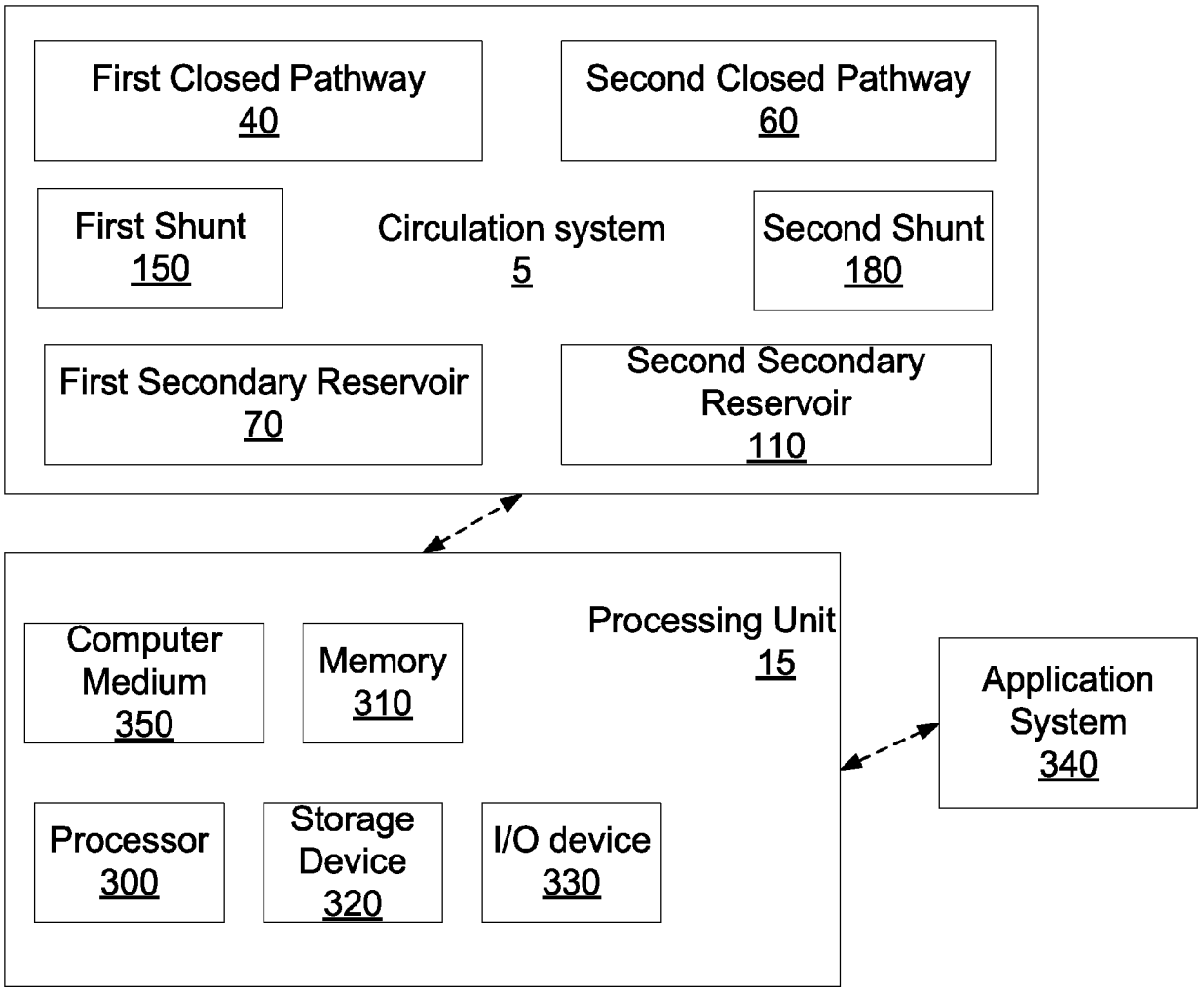
FIG. 1*b* is a schematic illustration of a processing unit for the circulation of ink within an ink delivery system, according to an example.

FIG. 1*b* is a schematic illustration of a processing unit for the circulation of ink within an ink delivery system, according to an example.

References are made herein to systems, devices, units and components that are also described, for example, above, with reference to FIG. 1*a*.

A processing unit 15 may be configured to run a non-transitory computer readable medium 350 to execute an ink delivery system and/or other systems, including ink delivery system 10 and/or ink circulation system 5. In some examples, processing unit 15 may be configured to run a non-transitory computer readable medium 350 to execute an ink delivery system within a printer, as described above. Processing unit 15 may include a processor 300, non-volatile memory 310, a storage device 320 and an I/O device 330, and/or other components.

Processing unit 15 may be configured to control, run, administer or otherwise communicate with one or a plurality of components of circulatory system 15, including pump 210, pump 290, filter 220, filter 280. Other components, including valves, pipes, shunts, and reservoirs, and pathways may also be controlled, run, administered or otherwise communicate with processing unit 15 and/or non-transitory computer readable medium 350.

Processing unit 15 may control, run, administer or otherwise communicate with an application system 340. Application system 340 may be configured to apply ink during a print job. The application system may include printer nozzles. The printer nozzles may be included within multi-nozzle printhead 20. Processing unit 15 may be configured to run non-transitory computer medium 350 to control a first closed pathway 40 for a first ink flow through a multi-nozzle printhead 20 in a first direction. Processing unit 15 may be further configured to run non-transitory computer medium 350 to administer a second closed pathway 60 for a second ink flow through multi-nozzle printhead 20. In some examples, second closed pathway 60 may be configured to move the second ink flow in a second direction, the second direction may be distinct from the first direction, e.g., in an opposite direction.

Processing unit 15 may be configured to run non-transitory computer medium 350 to direct, control, administer, or otherwise communicate with a first shunt 150, and/or related components of ink circulation system 5, between first closed pathway 40 and second closed pathway 60 at a first end of the multi-nozzle printhead 20. First shunt 150 may allow some of the first ink flow to merge with the second ink flow.

Processing unit 15 may be configured to run non-transitory computer medium 350 to direct, control, administer or otherwise communicate with a second shunt 180 and/or related components of ink circulation system 5, between first closed pathway 40 and second closed pathway 60 at a second end of the multi-nozzle printhead 20. Second shunt 180 may allow some of the second ink flow to merge with the first ink flow.

Processing unit 15 and/or non-transitory computer readable medium 350 may direct, control, administer or otherwise communicate with first closed pathway 40 and second closed pathway 60, and in some examples, ink may be circulated within first closed pathway 40 and second closed pathway 60, while the printer described above is in a standby mode.

In some examples, processing unit 15 and/or non-transitory computer readable medium 350 may direct, control, administer the flow of white ink in a printer.

Figure 2:
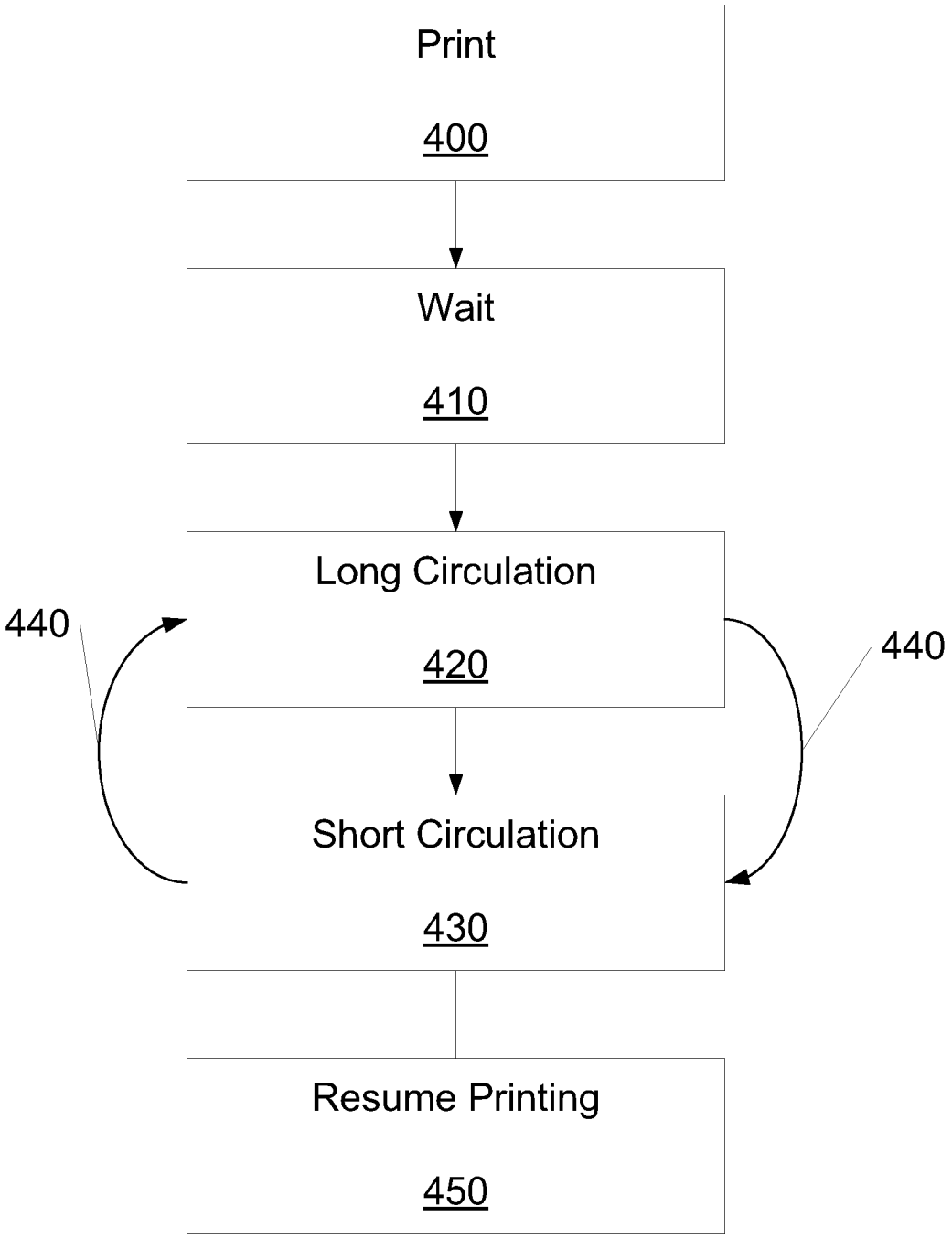
FIG. 2 is a schematic illustration of a method of controlling the circulation of ink in an ink delivery system, according to an example; and, FIG. 3 is a schematic illustration of a method for an ink delivery system, according to an example.

FIG. 2 is a schematic illustration of a method of controlling the circulation of ink within an ink delivery system, according to an example.

References are made herein to systems, devices, units and components that are also described, for example, above, with reference to FIG. 1*a*.

In some examples, a printer may include an ink circulation system within an ink delivery system. The printer may print on a substrate as depicted by box 400.

In some examples, once a printer stops printing, a processing unit, or other component, may begin a period of waiting. In some examples, the period of waiting may be five minutes. In some examples, the period of waiting may be longer or shorter. The period of waiting is depicted as box 410.

In some examples, after a five minute waiting period, a processing unit, or other component, may signal to the ink delivery system to begin an ink circulation while the printer is not printing.

The ink circulation may be divided into two components within a temporal period. For example, in every half hour period, there may be a 20 minute long circulation, the long circulation depicted as box 420. The long circulation may include circulating ink through multi-nozzle printhead 20, pipe 30 and/or pipe 50, first closed pathway 40 and/or second closed pathway 60, 'T' junction 100, combined ink flow pathway 200, valve 190, pump 210, filter 220, valve 230, pathway 240 to secondary ink reservoir 70 and/or pathway 250 to secondary ink reservoir 110.

In some examples, after the completion of the long circulation, there may be a shorter circulation, the shorter circulation depicted as box 430. In some examples, the shorter circulation may circulate ink in the vicinity of secondary ink reservoir 70 and/or secondary ink reservoir 110, but not through multi-nozzle printhead 20.

In some examples, the longer circulation, depicted as box 420, may include circulating ink through multi-nozzle printhead 20. The longer circulation as depicted as box 420 may include circulating ink through other components of an ink delivery system.

In some examples, additional circulations may also be included within the temporal period described above. The shorter circulation, as depicted as box 430 may be employed when a new ink supply is added to the printer.

Arrows 440 depict the repetitive process of continued circulation of ink, including in some examples, 20 minutes of a long circulation followed by 10 minutes of a shorter circulation of ink, the combined 30 minutes of ink circulation, or a fraction thereof, repeating itself until processing unit 15 or other component signals that the circulation of ink should cease. In some examples, processing unit 15 or other component may signal that the circulation of ink should be altered.

In some examples, the repetitive circulation of ink may end when the printer begins to print again, depicted as box 450. In some examples, other events may result in the end of the repetitive circulation of ink.

Figure 3:
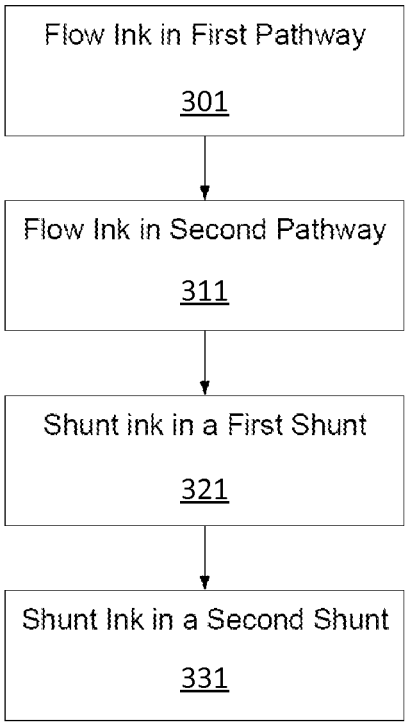

FIG. 3 is a schematic illustration of a method for an ink delivery system, according to an example.

A method for ink delivery may include flowing ink in a first closed pathway through a multi-nozzle printhead in a first direction, depicted as box 301.

A method for ink delivery may further include flowing ink in a second closed pathway through the multi-nozzle printhead in a second direction depicted as box 311.

A method for ink delivery may further include shunting some ink from the first closed pathway to the second closed pathway at a first end of the multi-nozzle printhead through a first shunt, the first shunt allowing some of the first ink flow to merge with the second ink flow, depicted as box 321.

A method for ink delivery may further include shunting some ink between the first closed pathway and the second closed pathway at a second end of the multi-nozzle printhead via a second shunt, the second shunt allowing some of the second ink flow to merge with the first ink flow, depicted as box 331.

Examples may include apparatuses for performing the operations described herein. Such apparatuses may be specially constructed for the desired purposes, or may comprise computers or processors selectively activated or reconfigured by a computer program stored in the computers. Such computer programs may be stored in a computer-readable or processor-readable non-transitory storage medium, any type of disk including floppy disks, optical disks, CD-ROMs, magnetic-optical disks, read-only memories (ROMs), random access memories (RAMs) electrically programmable read-only memories (EPROMs), electrically erasable and programmable read only memories (EEPROMs), magnetic or optical cards, or any other type of media suitable for storing electronic instructions. It will be appreciated that a variety of programming languages may be used to implement the teachings of examples, as described herein. Examples may include an article such as a non-transitory computer or processor readable non-transitory storage medium, such as for example, a memory, a disk drive, or a USB flash memory encoding, including or storing instructions, e.g., computer-executable instructions, which when executed by a processor or controller, cause the processor or controller to carry out methods disclosed herein. The instructions may cause the processor or controller to execute processes that carry out methods disclosed herein.

Different examples are disclosed herein. Features of certain examples may be combined with features of other examples; thus certain examples may be combinations of features of multiple examples. The foregoing description has been presented for the purposes of illustration and description. It is not intended to be exhaustive or to limit the examples to the precise form disclosed. It should be appreciated by persons skilled in the art that many modifications, variations, substitutions, changes, and equivalents are possible in light of the above teaching. It is, therefore, to be understood that the appended claims are intended to cover all such modifications and changes as fall within the true spirit of the examples.

While certain features of the examples have been illustrated and described herein, many modifications, substitutions, changes, and equivalents will now occur to those of ordinary skill in the art. It is, therefore, to be understood that the appended claims are intended to cover all such modifications and changes as fall within the true spirit of the examples.

What is claimed is:

1. An ink delivery system comprising:

a first closed pathway for a first ink flow through a multi-nozzle printhead in a first direction;

a second closed pathway for a second ink flow through the multi-nozzle printhead, the second pathway configured to move the second ink flow in a second direction;

a first shunt between the first closed pathway and the second closed pathway at a first end of the multi-nozzle printhead, the first shunt allowing some of the first ink flow exiting the multi-nozzle printhead to merge with the second ink flow entering the multi-nozzle printhead; and, a second shunt between the first closed pathway and the second closed pathway at a second end of the multi-nozzle printhead, the second shunt allowing some of the second ink flow exiting the multi-nozzle printhead to merge with the first ink flow entering the multi-nozzle printhead.

2. The system of claim 1, configured to be used in a printer.

3. The system of claim 1, configured to circulate ink within the first closed pathway and the second closed pathway while the system is in a standby mode.

4. The system of claim 1, wherein the ink comprises white ink.

5. The system of claim 1, wherein the first closed pathway and the second closed pathway comprise one or a plurality of ink reservoirs.

6. The system of claim 1, wherein the first shunt is shaped to comprise an inverted 'V'.

7. The system of claim 1, wherein the second shunt is shaped to comprise an inverted 'V'.

8. A non-transitory computer readable medium for ink delivery comprising instructions, which when executed cause a processor to:

control a first ink flow through a first closed pathway through a multi-nozzle printhead in a first direction;

control a second ink flow through a second closed pathway through the multi-nozzle printhead, the second pathway configured to move the second ink flow in a second direction;

direct the first ink flow through a first shunt between the first closed pathway and the second closed pathway at a first end of the multi-nozzle printhead, the first shunt allowing some of the first ink flow exiting the multi-nozzle printhead to merge with the second ink flow entering the multi-nozzle printhead; and, direct the second ink flow through a second shunt between the first closed pathway and the second closed pathway at a second end of the multi-nozzle printhead, the second shunt allowing some of the second ink flow exiting the multi-nozzle printhead to merge with the first ink flow entering the multi-nozzle printhead.

9. The non-transitory computer readable medium of claim 8, wherein the instructions are configured to be executed by a printer.

10. The non-transitory computer readable medium of claim 9, wherein the instructions are configured to be executed while the printer is in a standby mode.

11. The non-transitory computer readable medium of claim 8, wherein the instructions are configured to administer a flow of white ink.

12. The non-transitory computer readable medium of claim 8, wherein the instructions are configured to control the first closed pathway and the second closed pathway comprising one or a plurality of ink reservoirs.

13. The non-transitory computer readable medium of claim 8, wherein the instructions are configured to direct the first shunt shaped to comprise an inverted 'V'.

14. The non-transitory computer readable medium of claim 8, wherein the instructions are configured to direct the second shunt shaped to comprise an inverted 'V'.

15. A method for ink delivery, the method comprising:

flowing ink in a first closed pathway through a multi-nozzle printhead in a first direction;

flowing ink in a second closed pathway through the multi-nozzle printhead in a second direction;

shunting some ink from the first closed pathway to the second closed pathway at a first end of the multi-nozzle printhead through a first shunt, the first shunt allowing some of the first ink flow exiting the multi-nozzle printhead to merge with the second ink flow entering the multi-nozzle printhead; and, shunting some ink between the first closed pathway and the second closed pathway at a second end of the multi-nozzle printhead via a second shunt, the second shunt allowing some of the second ink flow exiting the multi-nozzle printhead to merge with the first ink flow entering the multi-nozzle printhead.

16. The method of claim 15, wherein the method is used in a printer.

17. The method of claim 16, wherein ink is circulated within the first closed pathway and the second closed pathway while the printer is in a standby mode.

18. The method of claim 15, wherein the ink flow comprises white ink.

19. The method of claim 15, wherein the first closed pathway and the second closed pathway comprise one or a plurality of ink reservoirs.

20. The method of claim 15, wherein shunting the ink comprises shunting the ink through a first shunt and a second shunt, wherein the first shunt and the second shunt are shaped to comprise an inverted 'V'.

* * * * *